US010308044B2

(12) United States Patent
Kano et al.

(10) Patent No.: US 10,308,044 B2
(45) Date of Patent: Jun. 4, 2019

(54) RECORDING APPARATUS AND RECORDING METHOD

(71) Applicant: CANON KABUSHIKI KAISHA, Tokyo (JP)

(72) Inventors: Yutaka Kano, Kawasaki (JP); Yuhei Oikawa, Yokohama (JP); Toshiyuki Chikuma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/989,024

(22) Filed: May 24, 2018

(65) Prior Publication Data

US 2018/0339526 A1 Nov. 29, 2018

(30) Foreign Application Priority Data

May 29, 2017 (JP) ..... 2017-106029

(51) Int. Cl.

| | |
|---|---|
| ***B41J 2/045*** | (2006.01) |
| ***B41J 11/00*** | (2006.01) |
| ***B41J 2/185*** | (2006.01) |
| ***B41J 2/14*** | (2006.01) |

(52) U.S. Cl.

CPC ..... *B41J 11/002* (2013.01); *B41J 2/14* (2013.01); *B41J 2/185* (2013.01)

(58) Field of Classification Search

CPC ..... B41J 2/04538; B41J 2/0454; B41J 2/04563; B41J 2/04565; B41J 11/002; B41J 2/14; B41J 2/185

See application file for complete search history.

(56) References Cited

U.S. PATENT DOCUMENTS

| | | | | |
|---|---|---|---|---|
| 2012/0194587 | A1* | 8/2012 | Teshigawara | B41J 2/0451 347/12 |
| 2013/0235098 | A1* | 9/2013 | Umeda | H02J 3/00 347/5 |
| 2016/0214378 | A1* | 7/2016 | Yoshida | B41J 2/04553 |
| 2017/0341381 | A1* | 11/2017 | Aoki | B41J 2/04528 |

FOREIGN PATENT DOCUMENTS

| | | |
|---|---|---|
| JP | 03-005151 A | 1/1991 |

* cited by examiner

*Primary Examiner* — Kristal Feggins

(74) *Attorney, Agent, or Firm* — Canon U.S.A., Inc. IP Division

(57) ABSTRACT

A recording apparatus includes a recording head that includes a plurality of recording devices containing ink, first and second heating devices, and first and second detection devices. The recording devices each generate energy for ejection of the ink, the first and second heating devices respectively heat the ink in a vicinity of recording devices located at first and second positions of the recording devices, and the first and second detection devices respectively detect temperatures in the vicinity of the recording devices located at the first and second positions. The recording apparatus includes an acquisition unit configured to acquire information relating to a representative temperature of the temperatures detected by the first and second detection devices, and a decision unit configured to decide an upper limit of driving power of each of the first and second heating devices.

16 Claims, 12 Drawing Sheets

FIG.7A

| ΔT | SH RANK |
|---|---|
| ΔT < 0 | 0 |
| 0 ≤ ΔT < 0.5 | 6 |
| 0.5 ≤ ΔT < 1.0 | 12 |
| 1.0 ≤ ΔT < 1.5 | 18 |
| 1.5 ≤ ΔT < 2.0 | 24 |
| ΔT ≥ 2.0 | 31 |

FIG.7B

| ΔT | SH RANK |
|---|---|
| ΔT < 0 | 0 |
| 0 ≤ ΔT < 0.5 | 6 |
| 0.5 ≤ ΔT < 1.0 | 12 |
| 1.0 ≤ ΔT < 1.5 | 18 |
| 1.5 ≤ ΔT < 2.0 | 21 |
| ΔT ≥ 2.0 | 21 |

FIG.8

SUB-HEATER DRIVING TIMING

| SH RANK | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 3 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 6 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 9 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 10 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 11 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 | 0 |
| 12 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 | 0 |
| 13 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 | 0 |
| 14 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 | 0 |
| 15 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 | 0 |
| 16 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 | 0 |
| 17 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 | 0 |
| 18 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 | 0 |
| 19 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 0 |
| 20 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 |
| 21 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 |
| 22 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 |
| 23 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 |
| 24 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 |
| 25 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 |
| 26 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 |
| 27 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 |
| 28 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 |
| 29 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 |
| 30 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 |
| 31 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 |

FIG.11

| HEATER BOARD | HB0 | | | | | HB1 | | | | | HB2 | | | | |
|---|---|---|---|---|---|---|---|---|---|---|---|---|---|---|---|
| SUB-HEATER | 23a | 23b | 23c | 23d | 23e | 23a | 23b | 23c | 23d | 23e | 23a | 23b | 23c | 23d | 23e |
| DEVIATION OF RESISTANCE VALUE FROM REFERENCE | -1 | -1 | -1 | -1 | -1 | 0 | 0 | 0 | 0 | 0 | 1 | 1 | 1 | 1 | 1 |
| HEAT DISSIPATION CHARACTERISTICS FROM REFERENCE | 2 | 1 | 0 | 1 | 2 | 2 | 1 | 0 | 1 | 2 | 2 | 1 | 0 | 1 | 2 |
| SH RANK CORRECTION VALUE | 1 | 0 | -1 | 0 | 1 | 2 | 1 | 0 | 1 | 2 | 3 | 2 | 1 | 2 | 3 |

RECORDING APPARATUS AND RECORDING METHOD

BACKGROUND

Field

The present disclosure relates to a recording apparatus and a recording method.

Description of the Related Art

There is a recording apparatus that records an image using a recording head, the recording head including a substrate in which a plurality of recording devices generating heat energy for ejection of ink is provided. In such a recording apparatus, if a temperature in the vicinity of the recording devices significantly decreases, an ink ejection amount may be excessively reduced, which may lower density of the image to be recorded.

To prevent the ejection amount from excessively decreasing due to a temperature drop as described above, in Japanese Patent Application Laid-Open No. 3-005151, a recording head is used that includes, in addition to the recording devices, a detection device that detects a temperature in the vicinity of the recording devices and a heating device that heats the vicinity of the recording devices. If the heating device and the detection device are used, the heating device can be driven to heat the vicinity of the recording device in the case where the temperature detected by the detection device becomes lower than a threshold; such a process makes it possible to suppress the above-described density lowering.

In the case of using the above-described recording head, the temperature detected by the detection device may be higher than the actual temperature of the ink in the recording apparatus in some cases. Such a gap between the detected temperature and the actual temperature may appear, for example, in a case where an ink tank is placed in a low-temperature environment before being attached to the recording apparatus, and the low-temperature ink is supplied to the vicinity of the recording devices in the recording.

When heat control discussed in Japanese Patent Application Laid-Open No. 3-005151 is performed, the detection device may detect relatively high temperature because of the detection device being located near the heating device. However, in a case where, outside the recording head, for example, the ink tank is placed in a low-temperature environment, the temperature of the ink inside the ink tank can become low due to influence of the low-temperature environment because heating is not performed near the ink tank. In other words, in some circumstances, the temperature detected by the detection device may be high due to influence of the heat control, while at the same time the temperature of the ink supplied from the ink tank may be low. Accordingly, although it may, in fact, be necessary to perform heat control because the actual temperature of the ink near the recording devices is low, heat control may not be performed because the detection device detects a temperature that is high.

To address this problem, the fixed temperature threshold used in the heat control may be set to a lower value so that heat control is also performed at the low temperature, anticipating that the detected temperature is higher than the actual temperature. In this case, however, the heat control may frequently be performed even in a case where a gap between the detected temperature and the actual temperature does not appear, which may unnecessarily increase driving power of the heating device.

The power consumed for recording by the recording head is mainly separated into driving power to drive the recording devices for ejection of the ink and driving power to drive the above-described heating device. The consumable power has an upper limit. Therefore, if the driving power of the heating device is unnecessarily increased, the total power consumption combining the driving power of the recording devices and the driving power of the heating device may exceed the upper limit, which may damage the recording head, a heater board, wirings, etc.

Besides, with respect to unnecessary driving power that may arise when the heating operation is performed in the heating device, a maximum value may be previously estimated, and the driving of the recording devices may be regulated so as to prevent the power consumption in the recording by the recording head from reaching the upper power limit, by obtaining maximum value previously. This, however, may unnecessarily reduce the driving power of the recording devices, by the above-described maximum value in the case where the detection error does not occur. When the number of ejections of the ink to a recording medium is increased scanning speed of the recording head is increased, it is necessary to increase the driving power of the recording devices; however, the driving power of the recording devices may become insufficient if the above-described method is employed, which may reduce the number of ejections or the recording speed, for example.

SUMMARY

The present disclosure is directed to suppressing excess power consumption and preventing driving power of a recording device from becoming insufficient even if detected temperature deviates from actual temperature in a heating operation by a heating device.

According to various embodiments of the present disclosure, a recording apparatus includes a recording head that includes a plurality of recording devices containing ink, first and second heating devices, and first and second detection devices. The recording devices each generate energy for ejection of the ink, the first and second heating devices respectively heat the ink in a vicinity of recording devices located at first and second positions of the recording devices, and the first and second detection devices respectively detect temperatures in the vicinity of the recording devices located at the first and second positions. The recording apparatus includes an acquisition unit configured to acquire information relating to a representative temperature of the temperatures detected by the first and second detection devices, a determination unit configured to determine whether the representative temperature or a first temperature threshold is higher, a decision unit configured to decide an upper limit of driving power of each of the first and second heating devices, based on a determination result of the determination unit, a recording control unit configured to drive the recording devices to control a recording operation, and a heat control unit configured to drive each of the first and second heating devices to control a heating operation during the recording operation, based on the temperatures respectively detected by the first and second detection devices and a second temperature threshold that is higher than the first temperature threshold. The heat control unit drives the first and second heating devices to cause the driving power to be lower than the decided upper limit indicated by the representative temperature related information. The decision unit decides the upper limit (i) so as to increase the upper limit in a case where the determination unit determines one time that the representative temperature is lower than the first temperature threshold, and (ii) so as to decrease the upper limit in a case where the determination unit consecutively determines N(N≥2) times that the representative temperature is higher than the first temperature threshold.

Further features will become apparent from the following description of exemplary embodiments with reference to the attached drawings.

BRIEF DESCRIPTION OF THE DRAWINGS

FIGS. 7A and 7B are diagrams illustrating correspondence between a temperature difference and a sub-heater (SH) rank according to the exemplary embodiment.

FIG. 8 is a diagram illustrating correspondence between the SH rank and driving information according to the exemplary embodiment.

FIG. 11 is a diagram illustrating an SH rank correction value according to the exemplary embodiment.

DESCRIPTION OF THE EMBODIMENTS

Figure 1:
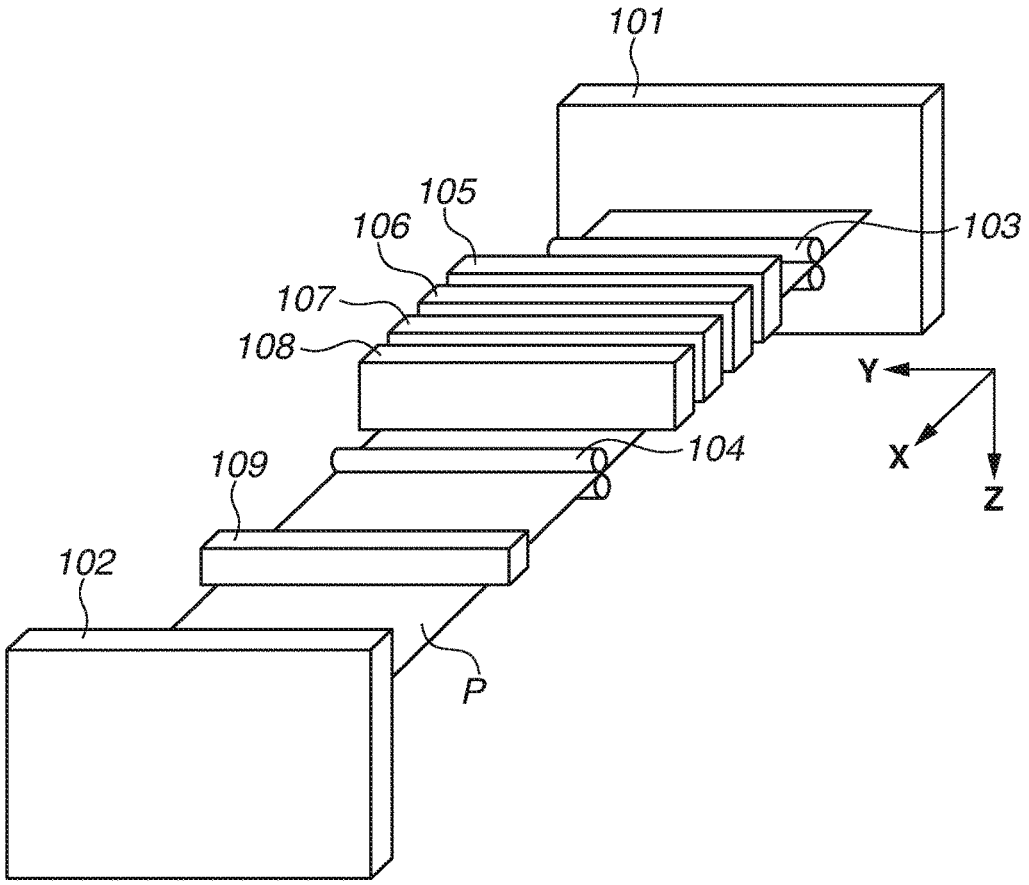
FIG. 1 is a diagram illustrating an internal configuration of a recording apparatus according to an exemplary embodiment.

FIG. 1 is a diagram illustrating an internal configuration of an inkjet recording apparatus (hereinafter, also referred to as recording apparatus) according to an exemplary embodiment.

A recording medium P fed from a feeding unit 101 is conveyed in +X direction (conveyance direction, intersecting direction) at a predetermined speed while being pinched by conveyance roller pairs 103 and 104 to be discharged to a discharging unit 102. Recording heads 105 to 108 are arranged side by side along the conveyance direction between the conveyance roller pair 103 on an upstream side and the conveyance roller pair 104 on a downstream side, and each eject ink in Z direction according to recording data. The recording heads 105, 106, 107, and 108 respectively eject the ink of cyan, magenta, yellow, and black. Each of the ink is held in a corresponding ink tank (not illustrated) that is detachable from the recording apparatus, and each of the ink is supplied to the recording heads 105 to 108 through a tube (not illustrated) from the ink tank.

In the present exemplary embodiment, the recording medium P may be a continuous sheet that is held in a roll shape by the feeding unit 101, or may be a cut sheet previously cut in a standard size. In a case of the continuous sheet, the sheet is cut into a predetermined length by a cutter 109 after recording operation by the recording heads 105 to 108 is completed, and the cut sheet is divided into discharge trays for respective sizes by the discharging unit 102.

(Recording Head)

Figure 2:
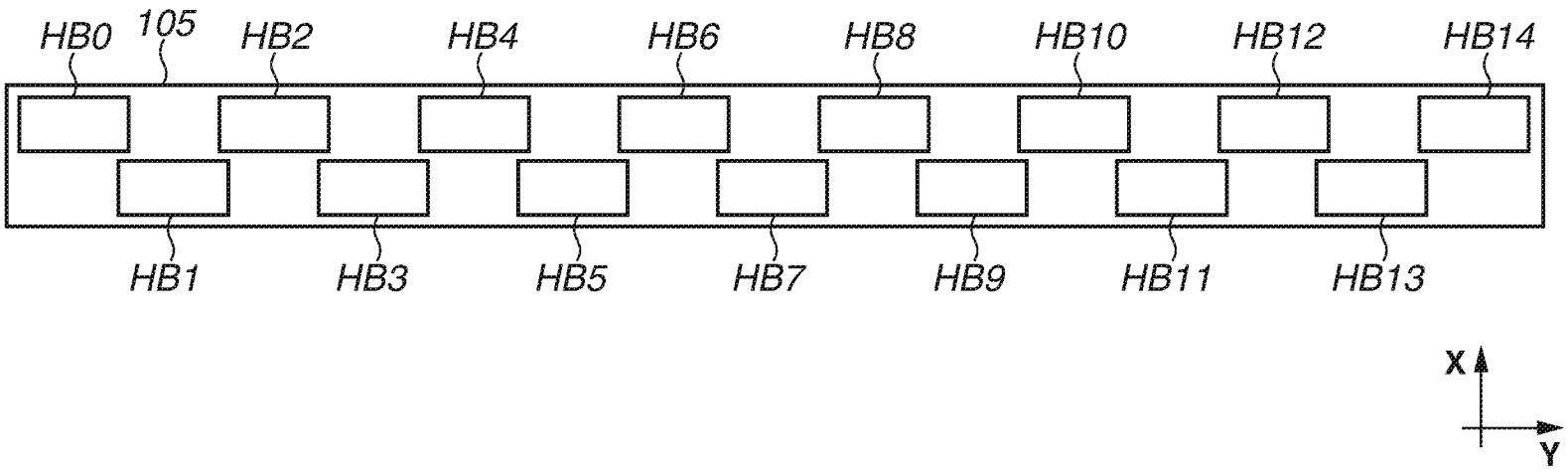
FIG. 2 is a diagram illustrating a recording head according to the exemplary embodiment.

FIG. 2 is a diagram illustrating a configuration of the recording head 105 for cyan ink used in the present exemplary embodiment. In the following description, only the recording head 105 out of the recording heads 105 to 108 is described for simplification; however, the recording heads 106 to 108 other than the recording head 105 also have a configuration similar to the configuration of the recording head 105.

As illustrated in FIG. 2, in the present exemplary embodiment, the recording head 105 includes 15 heater boards (recording device substrates) HB0 to HB14. The heater boards are arranged side by side along Y direction such that end parts of the respective heater boards in the Y direction partially overlaps with one another. By using the recording head in which the 15 heater boards HB0 to HB14 are arranged in the Y direction in such a manner, recording can be performed on an entire region of the recording medium that has a long width in the Y direction, as with a case of using a single elongated recording head.

Figure 3A:
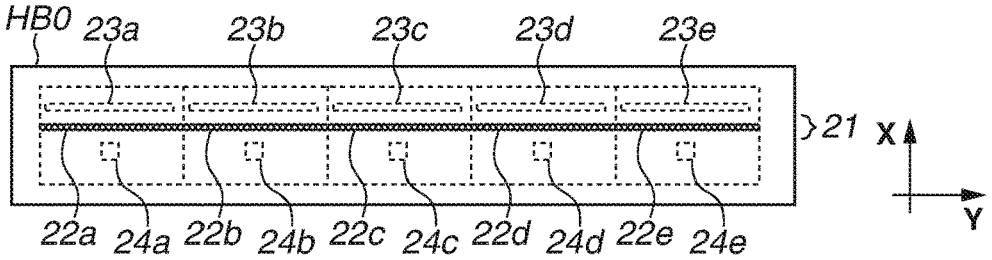
FIGS. 3A to 3C are diagrams each illustrating a heater board according to the exemplary embodiment.

FIG. 3A is a diagram illustrating a configuration of the heater board HB0 out of the heater boards HB0 to HB14. In this example, the heater board HB0 is described; however, the other heater hoard HB1 to HB14 also have a similar configuration.

As illustrated in FIG. 3A, the heater board HB0 includes an ejection port array 21 in which ejection ports for ejecting the cyan ink are arranged in the Y direction.

The heater board HB0 further includes five temperature sensors (detection devices) 24*a* to 24*e* and five sub-heaters (heating devices) 23*a* to 23*e*. The temperature sensor 24*a* and the sub-heater 23*a* are provided at positions near an upstream end part of the ejection port array 21 in the Y direction. In other words, the temperature sensor 24*a* detects a temperature of a region near an ejection port part 22*a* at the upstream end part of the ejection port array 21 in the Y direction, and the sub-heater 23*a* is used to heat the region near the ejection port part 22*a*. Likewise, in the ejection port array 21, the temperature sensor 24*b* and the sub-heater 23*b* correspond to an ejection port part 22*b* which is adjacent to the ejection port part 22*a*, and are respectively used for temperature detection and heating of the ejection port part 22*b*. Likewise, the temperature sensor 24*c* and the sub-heater 23*c* correspond to an ejection port part 2*c*, the temperature sensor 24*d* and the sub-heater 23*d* correspond to an ejection port part 22*d*, and the temperature sensor 24*e* and the sub-heater 23*e* correspond to an ejection port part 22*e* illustrated in FIG. 3A.

Thus, the ejection port array 21 in the heater board HB0 is divided into the five ejection port parts 22*a* to 22*e*, and temperature detection and heating are individually performed on each of the ejection port parts as described below. As described above, the recording head 105 for cyan ink includes the 15 heater boards HB0 to HB14. Accordingly, a total of 300 (=5×15×4) temperature sensors and 300 sub-heaters are provided for four colors. The temperature detection and heating can be individually carried out on 300 ejection port parts corresponding to the 300 temperature sensors and the 300 sub-heaters.

Figure 3B:
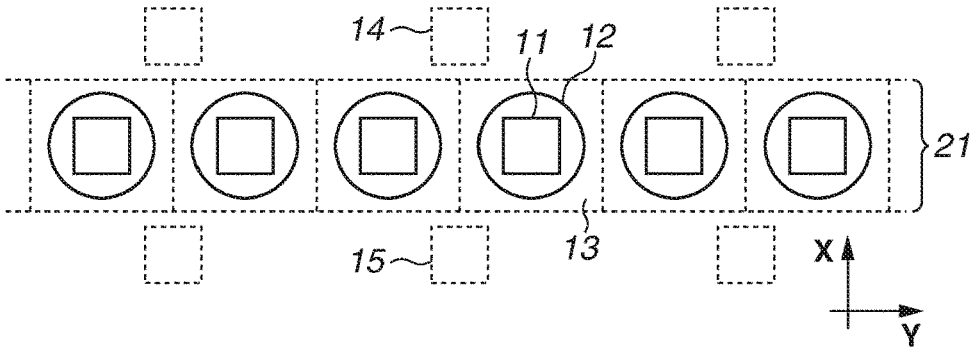

FIG. 3B is an enlarged view illustrating a side where a part of the ejection ports of the ejection port array 21 is formed in the heater board HB0.

As illustrated in FIG. 3B, recording devices 11 are disposed at positions corresponding to ejection ports 12 constituting the ejection port array 21. When a driving pulse is applied to the recording devices 11, each of the recording devices 11 is driven and generates heat energy, makes the ink foamed by the heat energy, and performs ejection operation through the corresponding ejection port 12. The recording devices 11 are provided inside pressure chambers 13 that are defined by partition walls. Further, ink supply ports 14 are provided in the direction of the ejection port array 21, and ink collection ports 15 are provided in −X direction of the ejection port array 21. More specifically, as illustrated in FIG. 3B, one ink supply port and one ink collection port 15 are provided for two ejection ports 12.

Figure 3C:
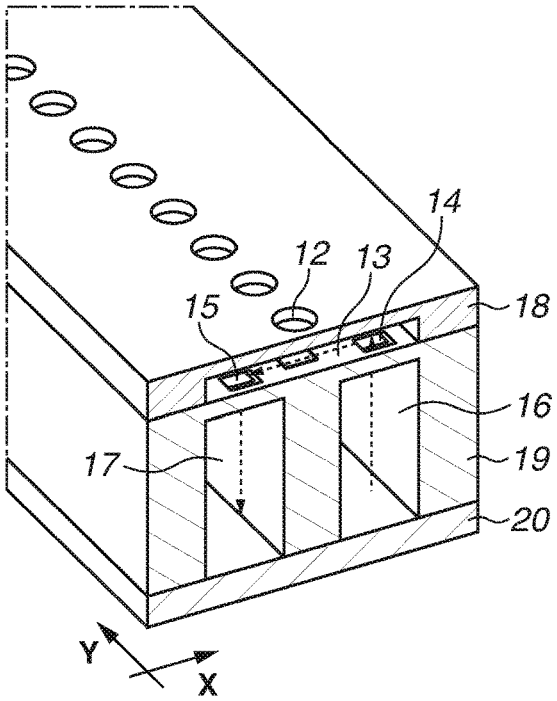

FIG. 3C is a cross-sectional view when a region inside the heater board HB0 illustrated in FIG. 3B is cut along a direction intersecting an XY plane.

As illustrated in FIG. 3C, the heater board HB0 includes three layers. More specifically, an ejection port forming member 18 formed of a photosensitive resin is stacked on a substrate 19 formed of silicon (Si), and a supporting member 20 is bonded to rear side of the substrate 19.

The above-described ejection ports 12 are provided on front side of the ejection port forming member 18. Further, the pressure chambers 13 that communicate with the ejection ports 12 are provided inside the ejection port forming member 18.

The above-described recording devices 11 are disposed on front side (ejection port forming member 18 side) of the substrate 19, and a common ink supply path 16 and a common ink collection path 17 are provided inside the substrate 19. Further, the ink supply ports 14 are provided so as to connect the common ink supply path 16 and the pressure chambers 13 inside the ejection port forming member 18, and the ink collection ports 15 are provided so as to connect the common ink collection path 17 and the pressure chambers 13 inside the ejection port forming member 18.

The common ink supply path 16 and the common ink collection path 17 are provided over the entire region where the ejection ports 12 are arranged in the Y direction. Further, as described below, the common ink supply path 16 and the common ink collection path 17 are controlled to generate negative pressure difference therebetween. Accordingly, when the ink is ejected from a part of the ejection ports 12 in the recording operation, the ink inside the common ink supply path 16 flows, due to the negative pressure difference, to the common ink collection path 17 through the ink supply ports 14, the pressure chambers 13, and the ink collection ports 15 in the ejection ports 12 that is not performing ejection (arrow in FIG. 3C). This flow allows for collection of thickened ink arising from evaporation from the ejection ports 12, bubbles, foreign matters, etc. that are generated in the ejection ports 12 and the pressure chambers 13 to, to the common ink collection path 17.

Further, the supporting member 20 functions as a lid that forms a part of a wall of the common ink supply path 16 and the common ink collection path 17 inside the substrate 19.

(Circulation Configuration)

Figure 4:
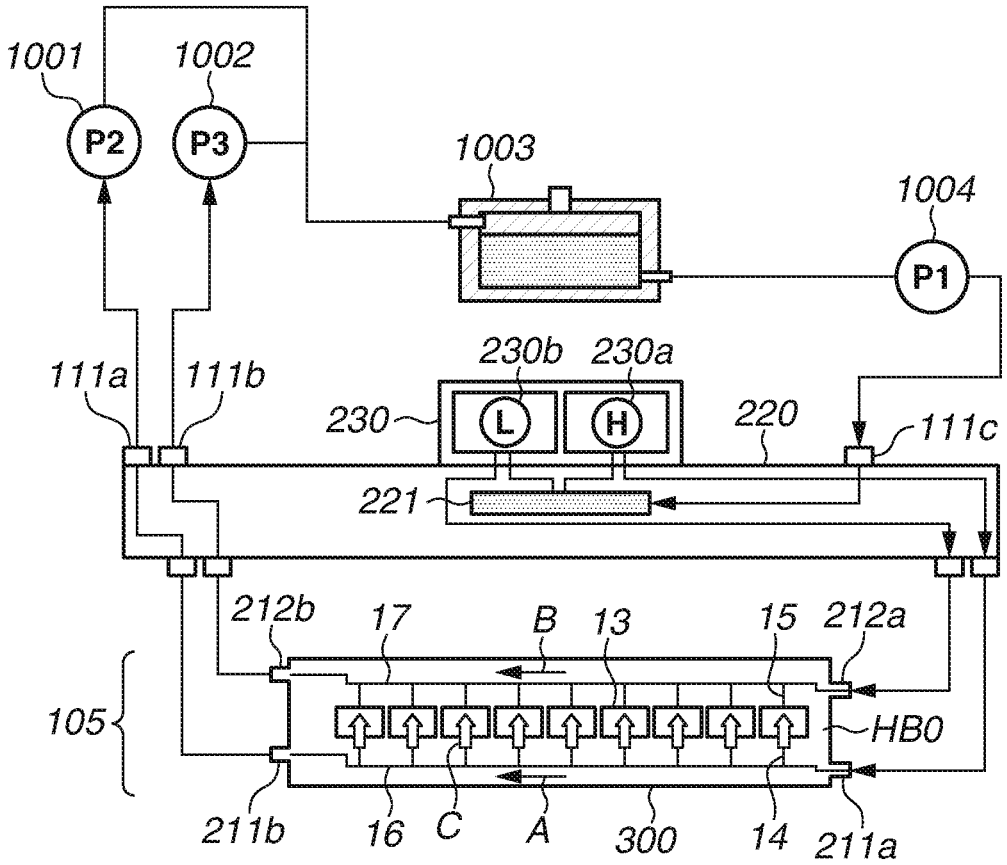
FIG. 4 is a diagram illustrating a circulation configuration according to the exemplary embodiment.

FIG. 4 is a schematic view illustrating a circulation configuration of a circulation path employed in the present exemplary embodiment. For the sake of simplicity, only the circulation path in the recording head 105 of the recording heads 105 to 108 is described; however, the circulation path in any of the other recording heads 106 to 108 has a similar configuration.

The recording head 105 is fluidically connected to a first circulation pump (P2) 1001 an a high-pressure side, a second circulation pump (P3) 1002 on a low-pressure side, and a main tank (ink tank) 1003. The main tank 1003 can discharge air bubbles the ink to the outside via an atmosphere communication port (not illustrated), through which the inside of the main tank 1003 is communicated with the outside. The ink inside the main tank 1003 is consumed in recording an image and performing recovery processing (including preliminary ejection, suction discharge, pressurization discharge, etc.), and the empty main tank 1003 is removed from the recording apparatus and is replaced.

As described above, the common ink supply path 16 and the common ink collection path 17 are provided in each of the heater boards HB0 to HB14 inside the recording head 105, and the pressure chambers 13 that communicate with one another through the ink supply ports 14 and the ink collection ports 15 are provided between the common ink supply path 16 and the common ink collection path 17. For the sake of simplicity, only the heater board HB0 of the heater boards HB0 to HB14 is illustrated in FIG. 4; however, the heater boards HB0 to HB14 are actually connected in series to one another. The heater board HB0 is located on the most upstream side (right side in FIG. 4), and the heater board HB14 is located on the most downstream side (left side in FIG. 4) in an ink circulation direction. The heater boards HB0 to HB14 are arranged in ascending order toward the downstream.

The first circulation pump 1001 sucks the ink inside the common ink supply path 16 through a connection portion 111*a* of a negative-pressure control unit 230 and an outlet 211*b* of the recording head 105, and returns the sucked ink to the main tank 1003. The second circulation pump 1002 sucks the ink inside the common ink collection path 17 through a connection portion 111*b* of the negative-pressure control unit 230 and an outlet 212*b* of the recording head 105, and returns the sucked ink to the main tank 1003. A positive-displacement pump having quantitative liquid feeding ability is preferably used as the first circulation pump 1001 and the second circulation pump 1002. Specific examples of the positive-displacement pump are a tube pump, a gear pump, a diaphragm pump, and a syringe pump, etc. Moreover, a general constant flow valve or a general relief valve may be provided at an outlet of the pump to secure a constant flow rate.

When the recording head 105 is driven, a constant amount of ink flows through the common ink supply path 16 in an arrow A direction (supply direction) in FIG. 4 by the first circulation pump 1001, and flows through the common ink collection path 17 in an arrow B direction (collection direction) in FIG. 4 by the second circulation pump 1002. The flow rate can be set to a low rate at which temperature differences among the heater boards HB0 to HB14 are suppressed to an extent which does not influence image quality of the recorded image. If the flow rate is excessively large, the negative pressure difference in each of the heater boards HB0 to HB14 may become excessively large due to influence of pressure loss of the flow path inside the recording head 105, which may cause density unevenness of the recorded image. Accordingly, the flow rate of the ink inside the common ink supply path 16 and the common ink collection path 17 is preferably set in consideration of the temperature difference and the negative-pressure difference among the heater boards HB0 to HB14.

The negative-pressure control unit 230 is provided in a flow path between a third circulation pump (P1) 1004 and the recording head 105. The negative-pressure control unit 230 includes a function of maintaining constant pressure of the ink on the recording head 105 side even in a case where the flow rate of the ink in an ink circulation system is varied according to the density (election amount) of the recorded image. Two pressure regulation mechanisms 230*a* and 230*b* constituting the negative-pressure control unit 230 may be any mechanisms as long as they can control the pressure in the flow path on the downstream of the mechanism to be within a fixed range centering on a desired setting pressure. As an example, a mechanism similar to that of a so-called depressurization regulator can be adopted. In a case of using the depressurization regulator, the inside of the upstream flow path of the negative-pressure control unit 230 is preferably pressurized through an ink supply unit 220 by the third circulation pump 1004 as illustrated in FIG. 4. Thus, influence of water head pressure between the main tank 1003 and the recording head 105 on the recording head 105 can be suppressed, and flexibility of the layout of the main tank 1003 can be enhanced in the recording apparatus. The third circulation pump 1004 is connected to the pressure regulation mechanisms 230*a* and 230*b* through the connection portion 111*b* of the negative-pressure control unit 230 and a filter 221. It is sufficient for the third circulation pump 1004 to have head pressure equal to or higher than a predetermined pressure within a range of the circulation flow rate of the ink when the recording head 105 is driven, and for example, a turbo pump or a positive-displacement pump may be used as the third circulation pump 1004. For example, a diaphragm pump is employable. Further, in place of the third circulation pump 1004, a water-head tank that is disposed with a predetermined water head difference with respect to the negative-pressure control unit 230, is employable.

Different control pressure is set to the two pressure regulation mechanisms 230*a* and 230*b* in the negative-pressure control unit 230. The pressure regulation mechanism 230*a* is denoted by "H" in FIG. 4 because the pressure regulation mechanism 230*a* is set to relatively high pressure, and the pressure regulation mechanism 230*b* is denoted by "L" in FIG. 4 because the pressure regulation mechanism 230*b* is set to relatively low pressure. The pressure regulation mechanism 230*a* is connected to an inlet 211*a* of the common ink supply path 16 of the recording head 105 through the inside of the ink supply unit 220. The pressure regulation mechanism 230*b* is connected to an inlet 212*a* of the common ink collection path 17 of the recording head 105 through the inside of the ink supply unit 220.

The pressure regulation mechanism 230*a* on the high-pressure side is connected to the inlet 211*a* of the common ink supply path 16, and the pressure regulation mechanism 230*b* on the low-pressure side is connected to the inlet 212*a* of the common ink collection path 17. Therefore, the negative pressure difference occurs between the common ink supply path 16 and the common ink collection path 17. Accordingly, a part of the ink flowing inside the common ink supply path 16 in the arrow A direction and a part of the ink flowing inside the common ink collection path 17 in the arrow B direction flow through the ink supply ports 14, the pressure chambers 13, and the ink collection ports 15 in an arrow C direction.

As described above, in the recording head 105, the ink flows through the common ink supply path 16 in the arrow A direction and the common ink collection path 17 in the arrow B direction in each of the heater boards HB0 to HB14. Accordingly, heat generated in each of the heater boards HB0 to HB14 is discharged to the outside while the ink flows through the inside of the common ink supply path 16 and the common ink collection path 17. In addition, such a configuration causes the flow of the ink also in the ejection ports 12 not ejecting the ink and the pressure chambers 13 in the arrow C direction during the recording operation, and suppresses thickening of the ink in such ejection ports 12 and pressure chambers 13. Moreover, the thickened ink and the foreign matters in the ink are discharged to the outside through the common ink collection path 17. As a result, it is possible to perform high-speed recording of a high-quality image with use of the recording head 105.

(Recording Control System)

Figure 5:
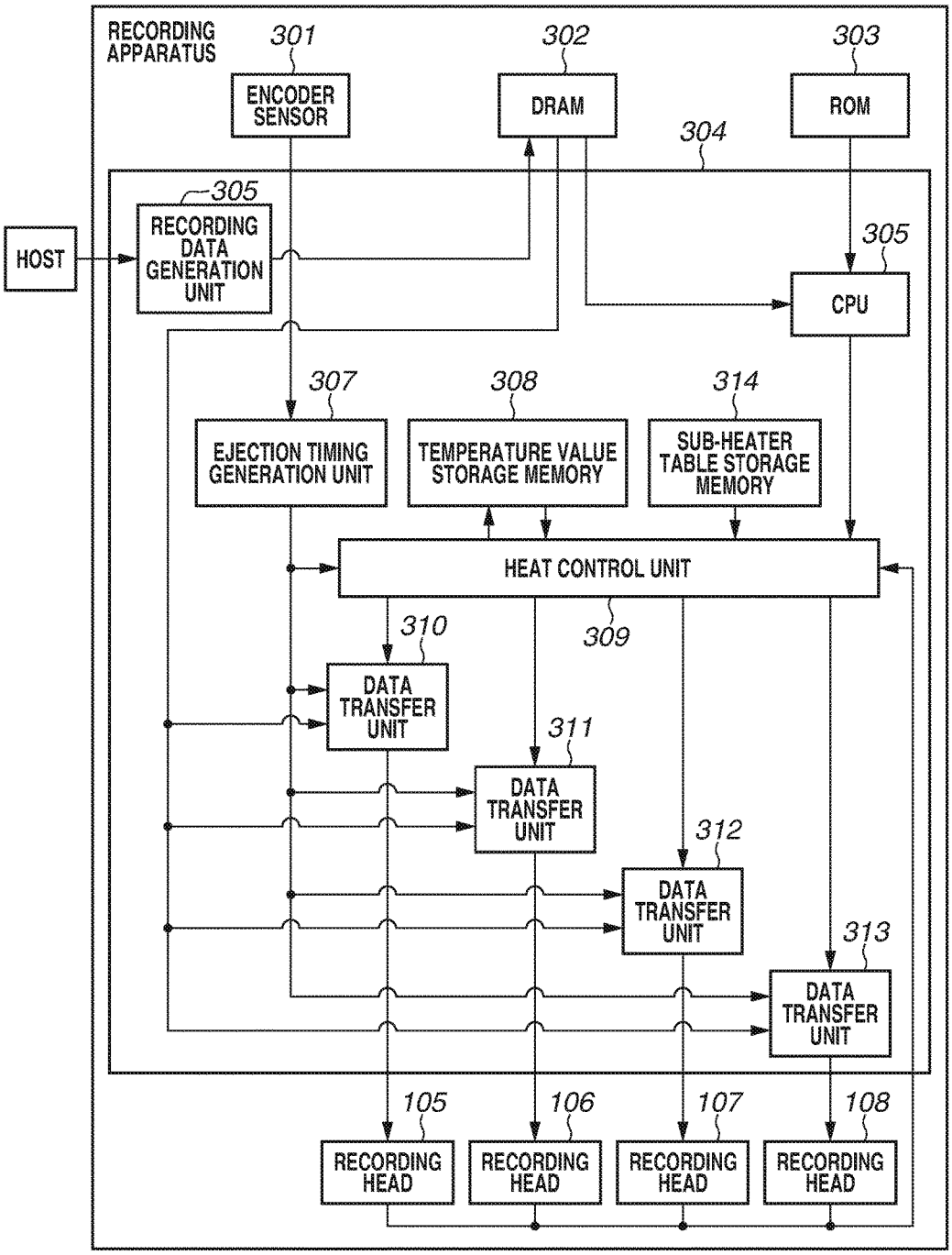
FIG. 5 is a diagram illustrating a recording control system according to the exemplary embodiment.

FIG. 5 is a diagram illustrating a configuration of a recording control system in the recording apparatus according to the present exemplary embodiment. For the sake of simplicity, only the recording control system relating to the recording head 105 of the recording heads 105 to 108 is described.

As illustrated in FIG. 5, the recording apparatus includes an encoder sensor 301, a dynamic random access memory (DRAM) 302, a read only memory (ROM) 303, a controller (application specific integrated circuit (ASIC)) 304, and the recording heads 105 to 108.

The controller 304 includes a recording data generation unit 305, a central processing unit (CPU) 306, an ejection timing generation unit 307, a temperature value storage memory 308, a sub-heater table storage memory 314, and data transfer units 310 to 313.

The CPU 306 reads a program stored in the ROM 303 to execute the program, and controls operation of the entire recording apparatus, for example, actuates a driver of each motor. Further, the ROM 303 holds fixed data necessary for various kinds of operation of the recording apparatus, in addition to the various kinds of control programs to be executed by the CPU 306. For example, the ROM 303 stores a program used to perform recording control in the recording apparatus.

The DRAM 302 is necessary for execution of the program by the CPU 306, and is used as a work area of the CPU 306 or as a temporal storage region of various reception data, or holds various kinds of setting data. While in FIG. 5, only one DRAM 302 is described, a plurality of DRAMs may be mounted, or a plurality of memories with different access speed may be mounted, which includes both of the DRAM and a static random access memory (SRAM).

The recording data generation unit 305 receives the image data from a host (personal computer (PC)) outside the recording apparatus. The recording data generation unit 305 performs color conversion processing, quantization processing, etc. on the image data, generates the recording data used for ejection of the ink from each of the recording heads 105 to 108, and stores the recording data in the DRAM 302.

The ejection timing generation unit 307 receives position information that indicates a relative position between each of the recording heads 105 to 108 and the recording medium P, detected by the encoder sensor 301. The ejection timing generation unit 307 generates ejection timing information that indicates timing of ejection of each of the recording heads 105 to 108, based on the position information.

The four data transfer units 310 to 313 read the recording data stored in the DRAM 302 at the ejection timing generated by the ejection timing generation unit 307. Further, the four data transfer units 310 to 313 generate sub-heater driving information in each of the heater boards HB0 to HB14 of each of the recording heads 105 to 108 held in the temperature value storage memory 308, based an temperature information held by the temperature value storage memory 308. The data transfer units 310 to 313 respectively transfer the recording data and the sub-heater driving information to the recording heads 105 to 108.

The recording heads 105 to 108 drive the recording devices to eject the ink with use of the transferred recording data, and provide the temperatures detected by the temperature sensors of the heater boards in the recording heads 105 to 108, to a heat control unit 309 inside the recording apparatus in the present exemplary embodiment, as described above, one heater board includes five temperature sensors, one recoding head includes 15 heater boards, and the recording heads are provided for four colors. Therefore, a total of 300 (=5×15×4) temperature sensors are provided, and 300 pieces of temperature information are provided to the heat control unit 309. The heat control unit 309 stores in the temperature value storage memory 308 the temperature information relating to the newly-detected temperature, and updates the temperature information. The updated temperature information is used at next timing of generating the sub-heater driving information.

(Temperature-Retention Control)

Temperature-retention control (sub-heater heat control) executed in the present exemplary embodiment is described in detail. In the temperature-retention control according to the present exemplary embodiment, the sub-heaters are driven to heat the ink near the recording devices and the temperature of the ink is retained in order to prevent the temperature near the recording devices from becoming low temperature which influences the ink election when the recording devices are driven to perform the ejection operation of the ink. In the following description, only the recording head 105 of the recording heads 105 to 108 is described for the sake of simplicity.

Figure 6:
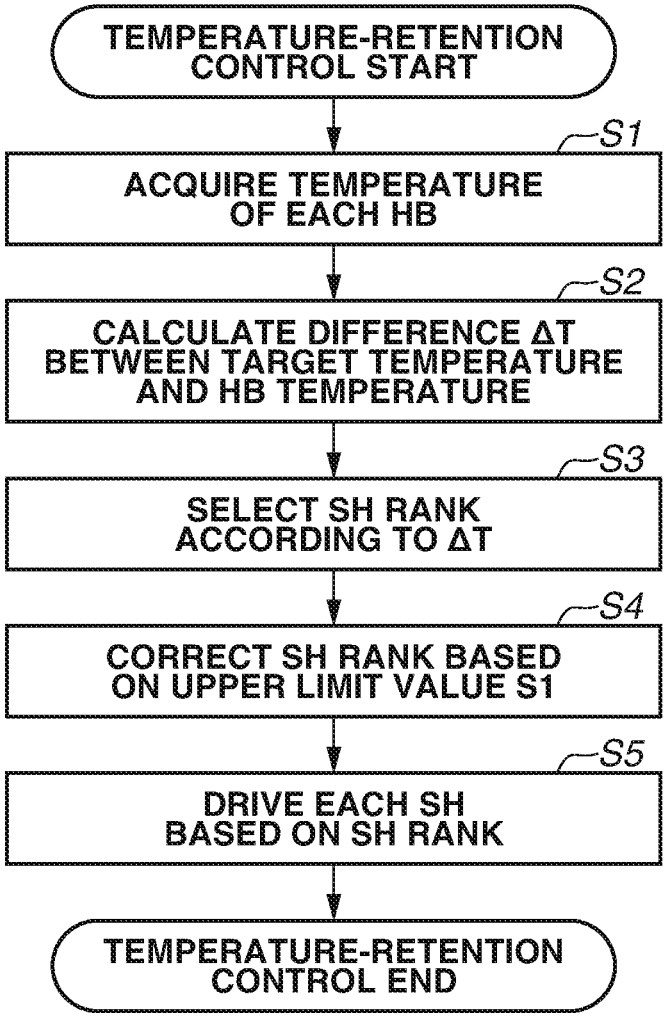
FIG. 6 is a flowchart illustrating temperature-retention control according to the exemplary embodiment.

FIG. 6 is a flowchart of the temperature-retention control (sub-heater heat control) executed by the heat control unit 309 according to the control program in the present exemplary embodiment.

First, in step S1, the temperatures detected by the temperature sensors 24*a* to 24*e* provided in each of the heater boards HB0 to HB14 inside the recording head 105 are acquired. As described above, the detected temperatures are held in the temperature value storage memory 308.

Next, in step S2, a difference (temperature difference) ΔT between each detected temperature and a predetermined target temperature T1 is calculated. More specifically, the temperature different ΔT is calculated by subtracting each detected temperature from the target temperature T1. The target temperature T1 corresponds to a temperature when the vicinity of the recording devices is heated to an extent which does not influence ejection of the ink, and the target temperature T1 is set to 40° C. in the present exemplary embodiment.

Next, in step S3, a sub-heater rank (hereinafter, also referred to as SH rank) indicating driving strength of the sub-heaters is selected according to the value of the temperature difference ΔT, with reference to the sub-heater table storage memory 314. The SH rank is selected for each of the sub-heaters 23*a* to 23*e* of the heater boards HB0 to HB14, based on the temperature difference ΔT in the temperature sensors 24*a* to 24*e* of the heater boards HB0 to HB14. In other words, since 75 (=5×15) sub-heaters are provided in the recording head 105, 75 SH ranks are individually selected. The temperature difference ΔT and the SH rank are associated with each other such that the sub-heater driving strength becomes larger as the temperature difference ΔT is larger. This is because the driving energy to be applied to the sub-heaters until the temperature reaches the target temperature T1 becomes larger as the detected temperature becomes lower compared with the target temperature T1.

FIG. 7A illustrates correspondence between the temperature difference ΔT and the SH rank according to the present exemplary embodiment. The larger SH rank, the larger sub-heater driving strength as shown in FIG. 7A. For example, when the temperature difference ΔT is lower than zero, the minimum SH rank "0" is selected because the detected temperature is higher than the target temperature T1. The SH rank "0" corresponds to non-driving of the sub-heater as described below. Further, for example, when the temperature difference ΔT is a large value equal to or higher than 2.0, the maximum SH rank "31" is selected because the detected temperature is significantly lower than the target temperature T1. The SH rank "31" substantially corresponds to driving the sub-heater all the time as described below.

Next, in step S4, the SH rank that has been selected for each of the sub-heaters 23*a* to 23*e* of the heater boards HB0 to HB14 in step S3 is corrected based on a temperature-retention upper limit S1. The temperature-retention upper limit S1 corresponds to an upper limit of the driving power which can be supplied to the sub-heater at that time, and is generated according to a flowchart described below.

Correction of the SH rank in step S4 in a case where the upper limit is "21" is now described. FIG. 7B illustrates the SH rank corresponding to the temperature difference ΔT after the correction is made in step S4 in the case where the upper limit is "21". In the present exemplary embodiment, in a case where the temperature difference ΔT is lower than zero, zero or higher and lower than 0.5, 0.5 or higher and lower than 1.0, or 1.0 or higher and lower than 1.5, the SH rank in step S3 is "0", "6", "12", or "18", respectively, therefore, is lower than the upper limit "21". Accordingly, the correction is not performed on the SH rank in step S4. On the other hand, in a case where the temperature difference ΔT is 1.5 or higher and lower than 2.0, or 2.0 or higher, the SH rank is "24" or "31", respectively, in step S3, and is higher than the upper limit "21". Accordingly, in these cases, since the driving power exceeds the driving power which can be supplied to the sub-heater, the SH rank is corrected to "21".

In step S5, the sub-heaters 23*a* to 23*e* of the heater boards HB0 to HB14 are driven based on the SH ranks determined in steps S3 and S4. At this time, the sub-heater driving information corresponding to the SH rank is output with reference to the sub-heater table storage memory 314.

FIG. 8 is a diagram illustrating correspondence between the SH rank and the sub-heater driving information according to the present exemplary embodiment. FIG. 8 shows how many times a signal "1" which indicates driving of the sub-heater and a signal "0" which indicates non-driving of the sub-heater are input, of 32 timings at which the sub-heater driving information can be input, for each of the SH ranks.

For example, in a case of the SH rank "0", it can be seen from a top row of FIG. 8 that the signal "0" indicating non-driving of the sub-heater is set in each of the sub-heater driving timings "0" to "31. Accordingly, when the SH rank is "0", the sub-heater is not driven even one time at 32 timings.

In a case of the SH rank "31", it can be seen from a bottom row of FIG. 8 that the signal "1" indicating driving of the sub-heater is set in sub-heater driving timings "0" to "30", and the signal "0" indicating non-driving of the sub-heater is set at timing "31". Accordingly, when the SH rank is "31", the sub-heater is driven 31 times of 32 timings.

As described above, it is possible to increase the number of driving times of the sub-heaters, namely, to increase the driving strength as the SH rank becomes larger, based on the correspondence illustrated in FIG. 8.

(Upper Limit Calculation Processing)

In the present exemplary embodiment, the temperature-retention upper limit S1 used in the above-described temperature-retention control is not fixed to a predetermined value but is varied according to predetermined timing.

In the recording apparatus, it is possible to accurately predict the driving power of the sub-heaters in the temperature-retention control if detection error does not occur in each of the temperature sensors 24*a* to 24*e* within the heater boards HB0 to HB14 of the recording heads 105 to 108. The power consumption that may vary during the predetermined operation relating to the recording heads 105 to 108 is mainly the driving power of the recording devices and the driving power of the sub-heaters. Therefore, if the driving power of the sub-heaters is predicted, it is possible to preset the driving power of the recording devices for the ejection operation, based on the driving power of the sub-heaters. Further, the recording apparatus is designed such that the driving power of the sub-heaters does not become so large in the temperature-retention control when the temperature is within the normal temperature range. Accordingly, a leeway can be comparatively given to the power used for driving the recording devices.

In a case where an error occurs and the detected temperature is lower than the actual temperature inside the recording apparatus in the temperature sensors 24*a* to 24*e*, however, the power larger than actually necessary power is used for driving the sub-heaters. In this case, the total power consumption of the driving power of the recording devices and the sub-heaters may exceed the upper limit of the power which can be supplied to the recording heads 105 to 108, the wirings, etc.

To suppress such excessive power consumption, a fixed value (fixed upper limit S2 described below) may be set as the upper limit of the driving power of the sub-heaters, taking account of the error of the detected temperatures that can occur in the temperature sensors 24*a* to 24*e*. As with the present exemplary embodiment, in a case where the driving power of the sub-heater is tentatively determined based on the temperature difference and the tentatively-determined driving power exceeds the upper limit, a correction may be made such that the driving power of the sub-heaters becomes equal to or lower than the upper limit to perform the temperature-retention control.

In this case, however, the upper limit of the driving power of the sub-heaters is set to a relatively large value taking account of the detection error. Therefore, the power usable for driving the recording devices is decreased. As a result, sufficient driving power may not be supplied even when it is necessary to increase the driving power of the recording devices.

Under such circumstances, in the present exemplary embodiment, the temperature-retention upper limit S1 is varied at the predetermined timing as described above, and too much consumption of the driving power of the sub-heaters, eventually excessive power consumption is suppressed while increasing the power used for driving of the recording device as much as possible even in the case where detection error occurs.

More specifically, first, the driving power (above-described fixed value) of the sub-heaters at which the power consumption does not exceed the upper limit of the power suppliable to the recording heads 105 to 108 and the wirings even when the detection error occurs, is stored as the fixed upper limit S2. The fixed upper limit S2 is used as the temperature-retention upper limit S1 of the driving power of the sub-heaters until a certain time elapses after the temperature-retention control is started.

After that, in a case where the temperatures detected by the temperature sensors 24*a* to 24*e* inside the heater boards HB0 to HB14 of the recording heads 105 to 108 are all higher than a retention determination temperature T2 for a while, it is determined that the temperature is sufficiently retained through the temperature-retention control, and the temperature-retention upper limit S1 is lowered (decreased).

The retention determination temperature T2 is used to determine whether the temperature is retained with the temperature-retention upper limit S1 at that time through the temperature-retention control.

Even in a case where the temperatures in the regions corresponding to each temperature sensor 24*a* to 24*e* are not sufficient and the temperature-retention control is accordingly performed in step S2, temperature can be retained if the temperature is sufficiently increased to the target temperature through the temperature-retention control with the temperature-retention upper limit S1 at that time. Therefore, the temperature-retention upper limit S1 is lowered. Accordingly, it can be seen that the retention determination temperature T2 can be lower than the target temperature T1 (40° C.). In the present exemplary embodiment, the retention determination temperature T2 is set to 39° C.

However, it is not possible to determine that the temperature is surely retained with the temperature-retention upper limit S1 at that time, based on the fact that the minimum temperature Tmin has exceeded the retention determination temperature T2 only one time. The minimum temperature Tmin barely exceeds the retention determination temperature T2 with the temperature-retention upper limit S1 at that time. In some cases, when the temperature-retention upper limit S1 is varied even only a little, the minimum temperature Tmin is decreased and the temperature may not be retained sufficiently. Accordingly, if the number (consecutive number) of times N that the minimum temperature Tmin consecutively exceeds the retention determination temperature T2 becomes equal to or larger than a consecutive threshold Nmax, the temperature-retention upper limit is first decreased. At this time, the consecutive threshold Nmax may be equal to or higher than two. In the present exemplary embodiment, the consecutive threshold Nmax is set to two.

On the other hand, in a case where the temperature hardly reaches the target temperature even when the temperature-retention control is performed at the temperature-retention upper limit S1 at that time, if the temperature-retention upper limit S1 is decreased, the temperature may not be suitably retained in spite of the temperature-retention control. Accordingly, in a case where the temperatures detected by the temperature sensors 24*a* to 24*e* become lower than the retention determination temperature T2, the temperature-retention upper limit S1 is increased to make the temperatures sufficient.

As described above, in the present exemplary embodiment, the temperature-retention control is performed while the temperature-retention upper limit S1 is varied.

Figure 9:
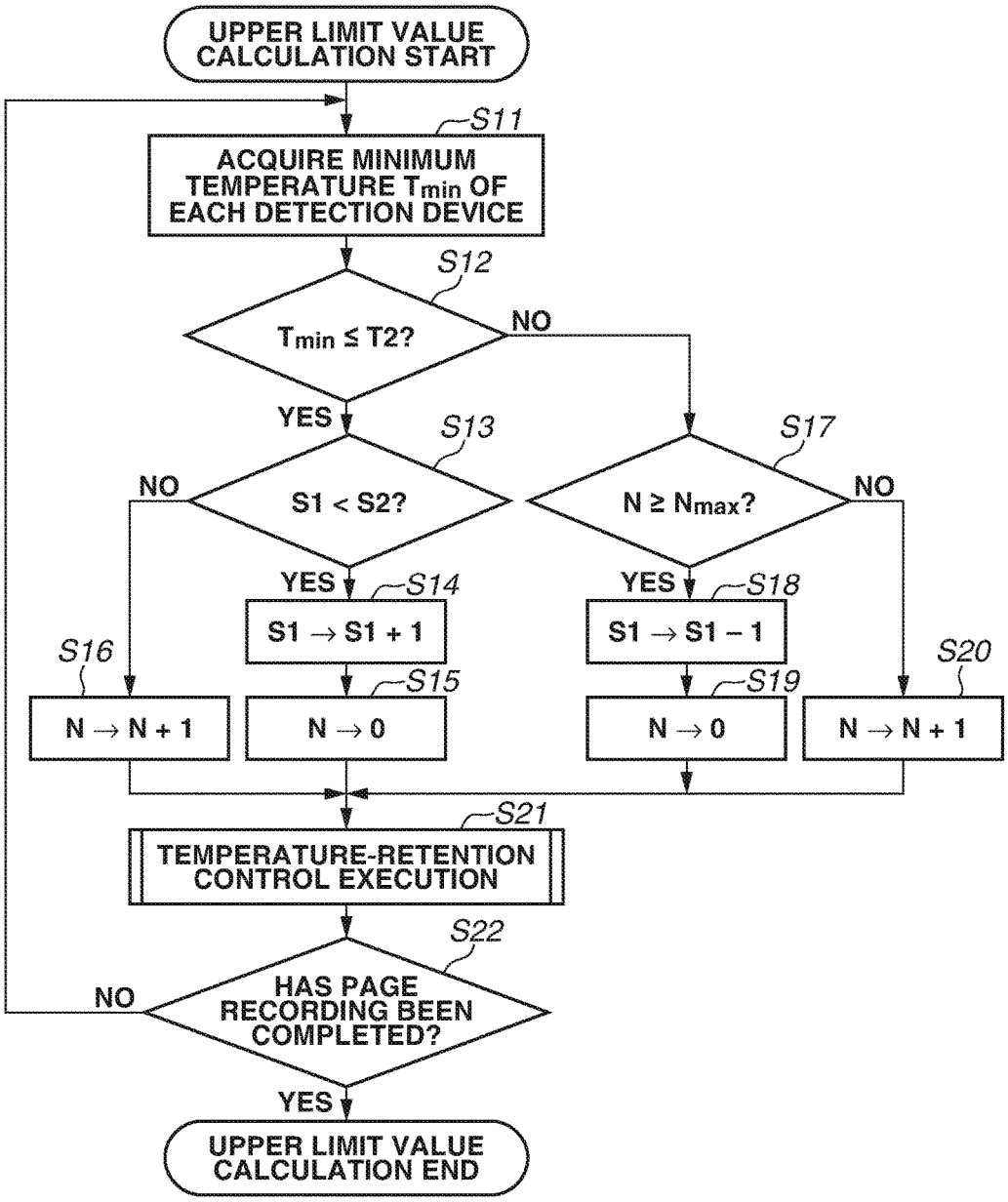
FIG. 9 is a flowchart illustrating an upper limit calculation method according to the exemplary embodiment.

FIG. 9 is a flowchart of the upper limit calculation processing executed by the heat control unit 309 according to the control program in the present exemplary embodiment.

When the upper limit calculation processing is started, the fixed upper limit S2, the retention determination temperature T2, and the consecutive threshold Nmax previously stored in the sub-heater table storage memory 314 are read out. The temperature-retention upper limit S1 is equal to the fixed upper limit S2 at a point of time immediately after the upper limit calculation processing is started. Further, the fixed upper limit S2 is a value set taking account of the detection error that may occur in the temperature sensors, and corresponds to the driving power, which is consumable by the sub-heaters.

Next, in step S11, the minimum temperature Tmin of the temperatures detected by the temperature sensors 24*a* to 24*e* within the heater boards HB0 to HB14 of the recording heads 105 to 108, is acquired.

Next, in step S12, it is determined whether the minimum temperature Tmin is lower than the retention determination temperature T2.

In a case where it is determined in step S12 that the minimum temperature Tmin is equal to or lower than the retention determination temperature T2 (Yes in step S12), the processing proceeds to step S13, and it is determined whether the temperature-retention upper limit S1 at that time is lower than the fixed upper limit S2. Since the temperature-retention upper limit S1 is equal to the fixed upper limit S2 immediately after the upper limit calculation processing is performed as described above, it is determined that the temperature-retention upper limit S1 is equal to or larger than the fixed upper limit S2 in step S13.

Next, in a case where it is determined in step S13 that the temperature-retention upper limit S1 is lower than the fixed upper limit S2 (Yes in step S13), the processing proceeds to step S14, and the temperature-retention upper limit S1 is incremented by one (added, increased, S1→S1+1). This is because the minimum temperature Tmin is lower than the retention determination temperature T2 in step S12, and the temperature-retention upper limit S1 is lower than the fixed upper limit S2 even though the region where the heating is insufficient appears at the upper limit at that time. Therefore, it is still possible to further increment the temperature-retention upper limit S1.

After that, the processing proceeds to step S15 and the consecutive number N is reset (initialized, N→zero).

In a case where it is determined in step S13 that the temperature-retention upper limit S1 is equal to or larger than the fixed upper limit S2 (No in step S13), the processing proceeds to step S16 without incrementing the upper limit, and the consecutive number N is incremented (added, increased) by one (N→N+1). Actually, the temperature-retention upper limit S1 does not become larger than the fixed upper limit S2, and the processing proceeds to step S16 when the temperature-retention upper limit S1 becomes equal to the fixed upper limit S2. This is because the temperature-retention upper limit S1 has already reached the fixed upper limit S2 and the temperature-retention upper limit S1 cannot be incremented any more.

On the other hand, in a case where it is determined in step S12 that the minimum temperature Tmin is larger than the retention determination temperature T2 (No in step S12), the processing proceeds to step S17, and it is determined whether the consecutive number N at that time is equal to or larger than the consecutive threshold Nmax.

In a case where it is determined in step S17 that the consecutive number N is equal to or larger than the consecutive threshold Nmax (Yes in step S17), the processing proceeds to step S18, and the temperature-retention upper limit S1 is decremented (subtracted, decreased) by one (S1→S−1). This is because the minimum temperature Tmin consecutively exceeds the retention determination temperature T2 the number of times corresponding to the consecutive threshold Nmax, and it is determined that the temperature-retention control is sufficiently performed at the temperature-retention upper limit S1 at that time. Therefore, the temperature-retention upper limit S1 is decremented in order to supply the power to the driving of the recording devices as much as possible.

After that, the processing proceeds to step S19, and the consecutive number N is reset (initialized, N→zero).

In a case where it is determined in step S17 that the consecutive number N is lower than the consecutive threshold Nmax (No in step S17), the processing proceeds to step S20 without decrementing the temperature-retention upper limit S1, and the consecutive number N is incremented (added, increased) by one (N→N+1).

After the process in any of steps S15, S16, S19 and S20 is performed, the processing proceeds to step S21 and the temperature-retention control described with reference to FIG. 6 is executed.

After that, the processing proceeds to step S22 and it is determined whether recording of one page has been completed. When it is determined that the recording has not been completed (No in step S22), the processing returns to step S11, and the minimum temperature Tmin is acquired again from the temperatures detected by the temperature sensors 24*a* to 24*e* within the heater boards HB0 to HB14 of the recording heads 105 to 108. After that, the processes in steps S12 to S21 are similarly repeated. On the other hand, in a case where it is determined that the recording of one page has been completed (Yes in step S22), the upper limit calculation processing ends.

As described above, according to the present exemplary embodiment, it is possible to maintain the driving power of the sub-heaters to be equal to or lower than the fixed upper limit S2 so as not to exceed the power consumption taking account of the detection error of the temperature sensors. Further, since the temperature-retention upper limit S1 is decremented in the case where the temperature-retention control is suitably performed at the temperature-retention upper limit S1 at that time, more power can be supplied to drive the recording devices as compared with the case where the fixed upper limit S2 is constantly used.

A second exemplary embodiment is described below. In the above-described exemplary embodiment, all of the heater boards HB0 to HB14 in each of the recording heads 105 to 108 are used.

In contrast, in the present exemplary embodiment, only a part of the heater boards HB0 to HB14 in each of the recording heads 105 to 108 is used.

As for parts similar to those in the above-described first exemplary embodiment, the description is omitted.

In the case where the width of the recording medium P in the Y direction is large, all of the heater boards HB0 to HB14 in each of the recording heads 105 to 108 are used. Therefore, it is necessary to use all of the temperature sensors and sub-heaters as described in the first exemplary embodiment.

In a case where the width of the recording medium P in the Y direction is small, however, the recording medium P may not pass right below, for example, the heater boards HB0, HB1, HB13, and. HB14 in each of the recording heads 105 to 108 in some cases. In this case, the heater boards HB0, HB1, HB13, and HB14 are not used for recording, and only the heater boards HB2 to HB12 are used for recording.

At this time, is unnecessary to perform the temperature-retention control on the heater boards HB0, HB1, HB13, and HB14 in each of the recording heads 105 to 108 because the ink is not in the first place ejected therefrom. Accordingly, in the case where the recoding is performed on the recording medium P having the small width in the Y direction, the temperature-retention control illustrated in FIG. 6 and the upper limit calculation processing illustrated in FIG. 8 are performed on only the heater boards HB2 to HB12 in each of the recording heads 105 to 108.

According to the above-described form, it is possible to limit the heater boards to be subjected to the temperature-retention control and the upper limit calculation processing in the case where the width of the recording medium, in the Y direction is small. This excludes consumption of excess driving power.

A third exemplary embodiment is described below. In the above-described exemplary embodiments, the temperature-retention control is performed during the recording operation.

In the present exemplary embodiment, pre-heat control is performed before the recording operation is started in addition to the temperature-retention control.

As for parts similar to those in the above-described first and second exemplary embodiments, the description is omitted.

In the pre-heat control, the sub-heaters are driven before the recording operation is started, to previously increase the temperature in order to prevent the temperature from becoming low immediately after the recording operation is started and to prevent the ejection amount from becoming excessively low.

Since the pre-heat control is performed before the recording operation is started, the recording devices are not driven at the same timing. Accordingly, the power is not consumed to drive the recording devices during the pre-heat control, and substantially all the power consumable by the recording heads 105 to 108 can be used to drive the sub-heaters in the pre-heat control. Therefore, in the pre-heat control, the driving of the sub-heaters is performed at a pre-heat fixed value S3 that is larger than the temperature-retention upper limit S1 and the fixed upper limit. S2.

Figure 10:
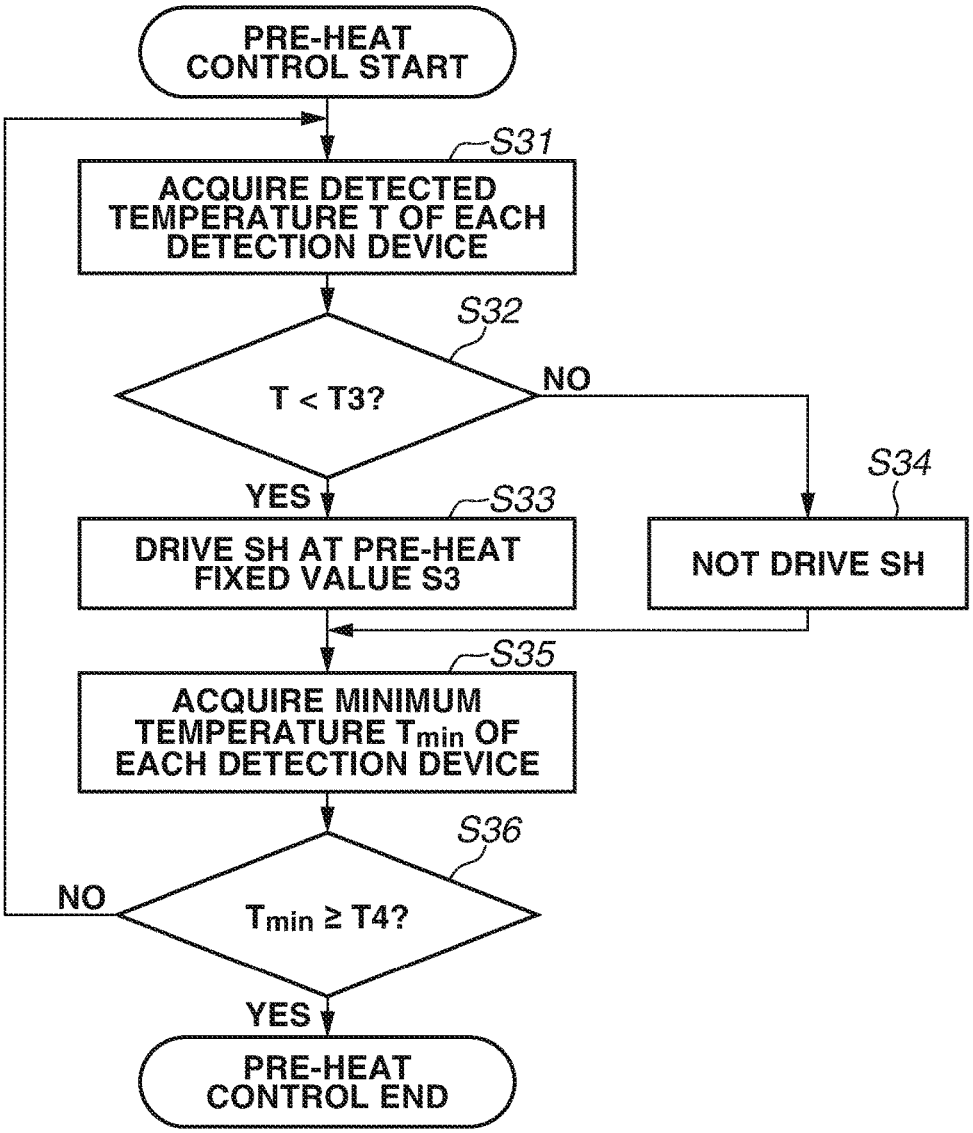
FIG. 10 is a flowchart illustrating pre-heating control according to the exemplary embodiment.

FIG. 10 is a flowchart of the pre-heat control that is executed by the heat control unit 309 according to the control program in the present exemplary embodiment.

When a recording job is received and preparation for recording start is started, the pre-heat control is also started.

When the pre-heat control is started, the temperatures T detected by the temperature sensors 24*a* to 24*e* in the heater boards HB0 to HB14 in each of the recording heads 105 to 108 are first acquired in step S31.

After that, in step S32, it is determined whether each of the temperatures T detected by the temperature sensors is lower than a temperature threshold T3. The temperature threshold T3 is set to 50° C. in the present exemplary embodiment.

The sub-heater located in a region corresponding to the temperature sensor, which determines the detected temperature T to be lower than the temperature threshold T3, is driven in step S33 and heating is performed. The recording devices are not driven during the pre-heat control as described above. Therefore, even if the driving power of the sub-heaters is increased, excess power consumption does not occur, and the time required for the pre-heat control is reduced when the sub-heaters are driven with the higher power. Accordingly, the sub-heaters are driven at the pre-heat fixed value S3 that is a higher value at this time. In the present exemplary embodiment, in the case of the pre-heat fixed value S3, the sub-heaters are driven with the SH rank "31" illustrated in FIG. 8.

On the other hand, as for a region corresponding to the temperature sensor, which determines the detected temperature T to be equal to or higher than the temperature threshold T3, the temperature is sufficiently high. Therefore, the processing proceeds to step S34 and the sub-heater located at that position is not driven.

After the process of either S33 or S34 is performed in each of the sub-heaters, the processing proceeds to step S35, and the minimum temperature Tmin of the temperatures T detected by the temperature sensors 24*a* to 24*e* within the heater boards HB0 to HB14 in each of the recording heads 105 to 108 is acquired.

The processing then proceeds to step S36, and it is determined whether the minimum temperature Tmin is equal to or higher than the temperature threshold T4. In the present exemplary embodiment, the temperature threshold T4 is set to 40° C. In a case where the minimum temperature Tmin is lower than the temperature threshold T4 (No in step S36), the pre-heating has not been sufficiently performed in a part of the regions. Therefore, the processing returns to step S31 and the processes in steps S32 to S35 for each of the temperature sensors and the sub-heaters are performed. On the other hand, in a case where the minimum temperature Tmin is equal to or higher than the temperature threshold T4 (Yes in step S36), the temperature is sufficiently high in all of the regions, and the pre-heat control ends.

As described above, in the present exemplary embodiment, in step S33, the sub-heaters are driven at the pre-heat fixed value S3 that is higher than the temperature-retention upper limit S1 at the time of the temperature-retention control described in the first exemplary embodiment. As described above, according to the present exemplary embodiment, in a case where the power is not used for driving the recording device, substantially all the consumable power is usable for the pre-heat control. This makes it possible to reduce the time elapsed until the pre-heat control ends.

A fourth exemplary embodiment is described below. In the above-described exemplary embodiments, the temperature-retention control is performed irrespective of the resistance values, the heat dissipation characteristics, etc. of the respective sub-heaters.

On the other hand, in the present exemplary embodiment, information relating to the resistance values and the heat dissipation characteristics of the sub-heaters is previously stored in the sub-heater table storage memory 314, and the temperature-retention control is performed taking account of the resistance values of the respective sub-heaters.

As for parts similar to those in the above-described first to third exemplary embodiments, its description is omitted.

The amount of flowing current is reduced and the driving power becomes insufficient as the resistance value of the sub-heaters becomes larger. Accordingly, the SH rank is preferably increased, and the driving power of the sub-heaters is preferably increased.

Further, the heat dissipation characteristics also change depending on the position in the Y direction in each of the heater boards HB0 to HB14. More specifically, much heat dissipation does not occur at a center part in the Y direction in each of the heater boards HB0 to HB14. However, the heat dissipation characteristics are high at the end parts in the Y direction because contact area of the substrate and the supporting member is large. Therefore, at the end parts, even when the same amount of the power as the center part is supplied to the sub-heaters, generated heat energy is smaller. Accordingly, the SH rank and the driving power of the sub-heaters are preferably increased as the heat dissipation characteristics becomes larger, namely, as the sub-heater is located closer to the end parts in the heater board in the Y direction.

Accordingly, in the present exemplary embodiment, a correction value for correcting the SH rank is changed according to the resistance value and the heat dissipation characteristics. Thus, the temperature-retention control can be suitably performed even if the resistance values are different in each sub-heater or the heat dissipation characteristics are different in each region.

FIG. 11 is a diagram illustrating an example of an SH correction value table that is used for calculating an SH rank correction value according to the resistance value and the heat dissipation characteristics in the present exemplary embodiment. In this example, for the sake of simplicity, the SH ranks of the total 15 sub-heaters 23*a* to 23*e* within the heater boards HB0 to HB2 in the recording head 105 of the recording heads 105 to 108 are illustrated. The SH ranks are similarly determined for the sub-heaters of the other heater boards and in the other recording heads.

In the present exemplary embodiment, as "deviation of resistance value from reference" in FIG. 11, "0" is determined in a case where the resistance value is not deviated from an ideal resistance value, "−1" is determined in a case where the resistance value is slightly lower than the ideal resistance value, and "1" is determined in a case where the resistance value is slightly larger than the ideal resistance value.

For example, "−1" is determined as the deviation of the resistance value for the sub-heater 23*a* of the heater board HB0. This means that the resistance value f the sub-heater 23*a* of the heater board HB0 is slightly lower than the ideal resistance value. In addition, "1" is determined as the deviation of the resistance value for the sub-heater 23*e* of the heater board. HB2. This means that the resistance value of the sub-heater 23*e* of the heater board HB2 is slightly larger than the ideal resistance value.

Furthermore, in the present exemplary embodiment, as "heat dissipation characteristics from reference" in FIG. 11, "0" is determined in a case where heat dissipation hardly occurs, "1" is determined in a case where the heat dissipation slightly occurs, and "2" is determined in a case where more heat dissipation occurs.

For example, "2" is determined as the heat dissipation characteristics for the sub-heater 23*a* of the heater board HB0. This means that the heat dissipation easily occurs in the sub-heater 23*a* of the heater board HB0 because the sub-heater 23*a* of the heater board HB0 is located at the end part in the Y direction in the heater board HB0.

Further, "0" is determined as the heat dissipation characteristics for the sub-heater 23*c* of the heater board HB0. This means that the heat dissipation hardly occurs on the sub-heater 23*c* of the heater board HB0 because the sub-heater 23*c* of the heater board HB0 is located at the center part in the Y direction within the heater board HB0.

As described above, in the present exemplary embodiment, the driving power is preferably increased as the resistance value becomes larger and the heat dissipation characteristics becomes larger. Therefore, the correction value of the SH rank is increased in a positive direction.

For example, as for the sub-heater 23*a* of the heater board HB0, "−1" is determined as the deviation of the resistance value, and "2" is determined as the heat dissipation characteristics. Accordingly, the correction value of the SH rank is set to "−1" in order to correct influence of the deviation of the resistance value, and the correction value of the SH rank is set to "2" in order to correct influence of the heat dissipation characteristics. Therefore, the correction value of the SH rank for the sub-heater 23*a* of the heater board HB0 becomes "1" by adding these correction values.

Further, as for the sub-heater 23*c* of the heater board HB2, "1" is determined as the deviation of the resistance value, and "0" is determined as the heat dissipation characteristics. Accordingly, the correction value of the SH rank is set to "1" in order to correct influence of the deviation of the resistance value, and the correction value of the SH rank is set to "0" in order to correct influence of the heat dissipation characteristics. Therefore, the correction value of the SH rank for the sub-heater 23*c* of the heater board HB2 becomes "1" by adding these correction values.

As described above, according to the present exemplary embodiment, it is possible to suitably perform the temperature-retention control even in the case where the resistance values and the heat dissipation characteristics are different in the sub-heaters.

A fifth exemplary embodiment is described below. In the present exemplary embodiment, the recording speed is varied according to the surplus power in driving the sub-heaters.

As for parts similar to those in the above-described first to fourth exemplary embodiments, its description is omitted.

In a case where the density of the recording image is high and it is necessary to increase the number of driving times of the recording devices in recording an image, the driving power is normally increased. In this case, by increasing the recording time, namely, by reducing the conveyance speed of the recording medium P, the number of driving times of the recording devices per unit time can be suppressed and accordingly, the driving power can be reduced.

In consideration of the above, for a case where the amount ejected toward a certain divided region of the recording medium is large and the number of driving times of the recording devices for the divided region is large, a method for reducing the recording speed and suppressing the driving power is known.

As described in the first exemplary embodiment, the power which can be used for driving the recording devices depends on the temperature-retention upper limit S1 that varies in the temperature-retention control. In other words, when the first exemplary embodiment is employed, S4=Smax (fixed value)−S1 variable), where the upper limit of the power that can be supplied to the recording heads 105 to 108 and the wirings is Smax, and the power which can be used for driving the recording devices is a driving upper limit S4. Therefore, the power usable for driving the recording devices also varies.

Accordingly, in the present exemplary embodiment, an ejection amount threshold Dth for determining whether to reduce the recording speed can be used for driving the recording devices, and the ejection amount threshold Dth is varied according to the variable driving upper limit S4 (=Smax−S1). In other words, in the case where the driving upper limit S4 is large, the driving power of the recording devices does not exceed the driving upper limit S4 even if the ejection amount of the ink is large or even if the recording devices are driven at the high recording speed. Therefore, the ejection amount threshold Dth is increased in order to suppress reduction in the recording speed. In this configuration, it can be more suitably determined whether it is necessary to reduce the recording speed in order to suppress excess power consumption.

Figure 12:
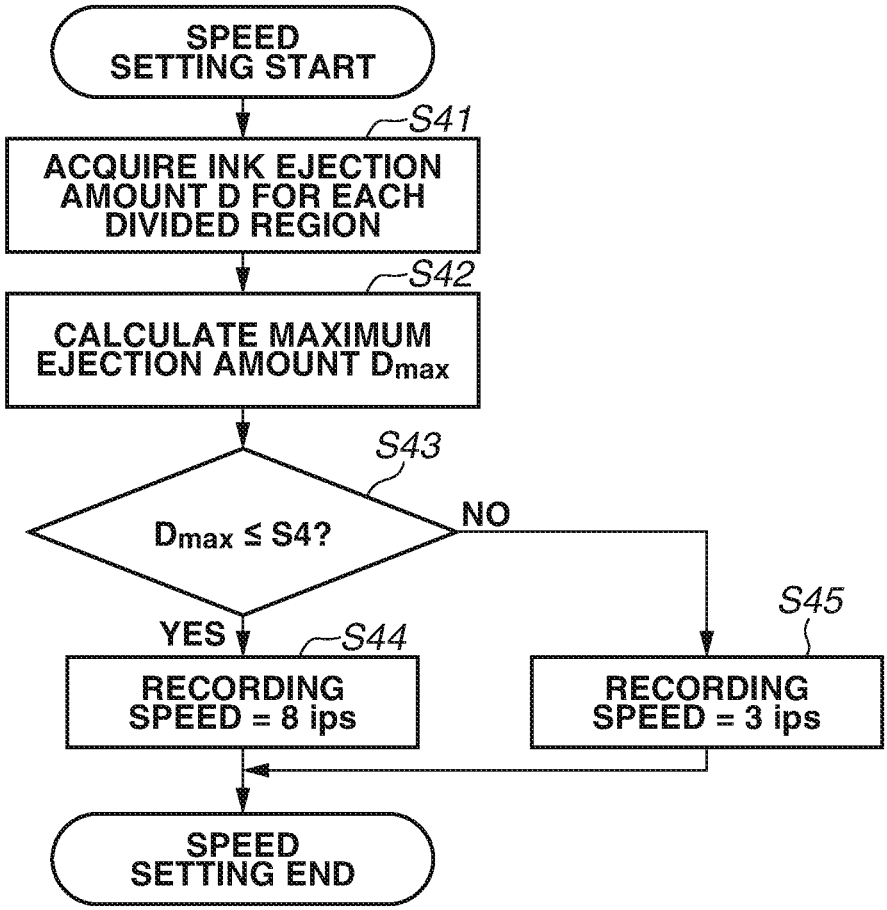
FIG. 12 is a flowchart illustrating a speed setting method according to the exemplary embodiment.

FIG. 12 is a flowchart for recording speed setting performed by the CPU 306 according to the control program in the present exemplary embodiment. The speed setting processing in the present exemplary embodiment is performed every time recording of one page is started.

When the speed setting processing is started, the recording medium is first divided in the X direction and Y direction into a plurality of divided regions in step S41. The ejection amount D of the ink determined by the recording data is then acquired for each of the divided regions.

Next, in step S42, the maximum ejection amount Dmax of the ink ejection amounts D of the respective divided regions, is calculated. The large amount ejected toward a certain divided region indicates that the number of driving times of the recording device for the certain divided region is large. Accordingly, in the divided region of the maximum ejection amount Dmax the driving power of the recording device is the largest in the recording of the page.

Next, in step S43, it is determined whether the maximum ejection amount Dmax is equal to or lower than the ejection amount threshold Dth. As described above, the ejection amount threshold Dth is increased as the driving upper limit S4 becomes larger, and the driving upper limit S4 is increased as the temperature-retention upper limit S1 becomes smaller. Accordingly, in the case where the temperature-retention upper limit S1 is small, the ejection amount threshold value Dth is increased.

In a case where it is determined that the maximum ejection amount Dmax is equal to or lower than the ejection amount threshold Dth (Yes in step S43), the excess power consumption does not occur even when the recording speed is increased. Therefore, the processing proceeds to step S44, and the recording speed is set to 8 ips.

On the other hand, in a case where it is determined that the maximum ejection amount Dmax is larger than the ejection amount threshold Dth (No in step S43), the excess power consumption may occur if the recording speed is increased. Therefore, the processing proceeds to step S45, and the recording speed is set to 3 ips.

After the process in either step S44 or S45 is performed, the speed setting processing ends.

As described above, the ejection amount threshold Dth for setting the recording speed is varied depending on the temperature-retention upper limit S1 that is used in the temperature-retention control in the present exemplary embodiment. This makes it possible to more accurately make a determination whether the ejection amount does not cause the excess power consumption if the recording speed is increased, or the ejection amount may cause the excess power consumption if the recording speed is not reduced.

(Other Exemplary Embodiments)

In the exemplary embodiments, the ink of cyan, magenta, yellow, and black is ejected from separate recording heads 105 to 108; however, the ejection may be performed in other forms. The ink of cyan, magenta, yellow, and black may be ejected from one recording head. Further, an ejection port array that ejects the ink of cyan, magenta, yellow, and black may be provided in the same heater board.

In addition, in a mode of the exemplary embodiments, the temperatures respectively detected by the temperature sensors 24*a* to 24*e* within the heater boards HB0 to HB14 of the recording heads 105 to 108 are acquired in step S11 of FIG. 9 and the minimum temperature Tmin is acquired from among the detected temperatures; however, the temperature can be acquired in other forms. For example, from among the plurality of detected temperatures, three lower temperatures are acquired, and an average temperature thereof may be used as a representative temperature in the upper limit determination processing, in place of the minimum temperature Tmin. As described above, the representative temperature may not necessarily be the minimum temperature Tmin as long as the relatively low temperature is used.

Further, if a region where the temperature is easily lowered is previously known, the temperature detected by the temperature sensor corresponding to the region may be regarded as the representative temperature in place of the minimum temperature Tmin. For example, in the case of using the circulation configuration described in the exemplary embodiments, the temperature is easily lowered in a region located on upstream side in the supply direction A and the collection direction B of the ink of each of the recording heads illustrated in FIG. 4. This is because, the ink having the temperature lower than the environmental temperature in the recording apparatus flows in front through the region on the upstream side in the supply direction A and the collection direction B. In this case, the temperature detected by the temperature sensor in the region on the most upstream side in the supply direction A and the collection direction B in each of the recording heads may be regarded as the representative temperature and used in the upper limit calculation processing, in place of the minimum temperature Tmin.

In the exemplary embodiments, the upper limit is increased in the case where it is determined one time that the temperature is lower than the threshold, and the upper limit is decreased in the case where it is determined a plurality of consecutive times that the temperature is higher than the threshold. However, when a case where the upper limit is decreased, and a case where the upper limit is increased, are considered, if in the former case the temperature is compared with the threshold a larger number of times, then similar effects can be achieved. For example, the upper limit may be increased in a case where it is consecutively determined twice that the temperature is lower than the threshold, and the upper limit may be decreased in a case where it is consecutively determined four times that the temperature is higher than the threshold. In other words, the upper limit may be increased in a case where it is consecutively determined M(M≥2) times that the temperature is lower than the threshold, and the upper limit may be decreased in a case where it is consecutively determined N (N>M) times that the temperature is higher than the threshold.

Furthermore, in the exemplary embodiments, the recording head larger in width than the recording medium is used and the recording is performed while the recording medium is conveyed. Alternatively, the recording may be performed in other forms. For example, a recording operation in which the ink is ejected while the recording head scans in a direction intersecting the arrangement direction of the ejection ports, and a conveyance operation in which the recording medium is conveyed in the arrangement direction between the scannings may be repeatedly carried out, and the recording on the recording medium is completed by scanning (movement) a plurality of times.

In the recording apparatus according to the exemplary embodiments, excess power consumption and insufficiency of the driving power of the recording devices can be suppressed even if the detected temperature and the actual temperature deviate from each other in the heating operation by the heating devices.

While exemplary embodiments have been described, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-106029, filed May 29, 2017, which is hereby incorporated by reference herein in its entirety.

What is claimed is:

1. A recording apparatus including a recording head, the recording head including a plurality of recording devices containing ink, first and second heating devices, and first and second detection devices, the recording devices each generating energy for ejection of the ink, the first and second heating devices respectively heating the ink in a vicinity of recording devices located at first and second positions of the recording devices, and the first and second detection devices respectively detecting temperatures in the vicinity of the recording devices located at the first and second positions, the recording apparatus comprising:

an acquisition unit configured to acquire information relating to a representative temperature of the temperatures detected by the first and second detection devices;

a determination unit configured to determine whether the representative temperature or a first temperature threshold is higher;

a decision unit configured to decide an upper limit of driving power of each of the first and second heating devices, based on a determination result of the determination unit;

a recording control unit configured to drive the recording devices to control a recording operation; and a heat control unit configured to drive each of the first and second heating devices to control a heating operation during the recording operation, based on the temperatures respectively detected by the first and second detection devices and a second temperature threshold that is higher than the first temperature threshold, wherein the heat control unit drives the first and second heating devices to cause the driving power to be lower than the decided upper limit indicated by the representative temperature related information, and wherein the decision unit decides the upper limit (i) so as to increase the upper limit in a case where the determination unit determines one time that the representative temperature is lower than the first temperature threshold, and (ii) so as to decrease the upper limit in a case where the determination unit consecutively determines N(N≥2) times that the representative temperature is higher than the first temperature threshold.

2. The recording apparatus according to claim 1, wherein the decision unit decides the upper limit so as not to change the upper limit in a case where the determination unit determines one time that the representative temperature is higher than the first temperature threshold.

3. The recording apparatus according to claim 1 wherein the decision unit decides the upper limit so as not to change the upper limit in a case where the determination unit consecutively determines N−1 times that the representative temperature is higher than the first temperature threshold.

4. The recording apparatus according to claim 1, wherein the heat control unit drives the first and second heating devices, based on a difference between each of the temperatures detected by the first and second detection devices and the second temperature threshold.

5. The recording apparatus according to claim 4, wherein the heat control unit drives each of the first and second heating devices in a range of the driving power which is smaller than the upper limit indicated by the information, in such a way that the larger the difference, the larger the driving power.

6. The recording apparatus according to claim 1, wherein the acquisition unit acquires, as the information relating to the representative temperature, information relating to a lower temperature of the temperatures detected by the first and second detection devices.

7. The recording apparatus according to claim 6, wherein the acquisition unit acquires, as the information relating to the representative temperature, information relating to the temperature detected by the second detection device.

8. The recording apparatus according to claim 1, wherein the recording head further includes a plurality of ejection ports, a plurality of pressure chambers, a supply path, and a collection path, the ejection ports each ejecting the ink, the pressure chambers respectively communicating with the ejection ports and including the recording devices, the supply path supplying the ink to the pressure chambers, and the collection path collecting the ink from the pressure chambers, and wherein the second position is located on an upstream side from the first position of the supply path in an ink supply direction.

9. The recording apparatus according to claim 8, wherein the ink in the pressure chambers is circulated between the inside and the outside through the supply path and the collection path.

10. The recording apparatus according to claim 1, further comprising a second heat control unit configured to drive each of the first and second heating devices to control the heating operation before the recording operation, based on each of the temperatures detected by the first and second detection devices and a third temperature threshold, the second heat control unit driving the first and second heating devices to cause the driving power to be larger than the upper limit indicated by the information.

11. The recording apparatus according to claim 1, wherein the heat control unit drives the first and second heating devices, based on resistance values of the first and second heating devices.

12. The recording apparatus according to claim 1, wherein the heat control unit drives the first and second heating devices, based on heat dissipation characteristics of regions provided with the first and second heating devices.

13. The recording apparatus according to claim 1, further comprising:

a second acquisition unit configured to acquire information relating to an ejection amount of the ink ejected toward a recording medium; and a setting unit configured to set recording speed in the recording operation, based on the information acquired by the second acquisition unit and an ejection amount threshold, wherein the ejection amount threshold is determined based on the information relating to the upper limit decided by the decision unit.

14. A recording apparatus including a recording head, the recording head including a plurality of recording devices containing ink, a heating device, and a detection device, the recording devices each generating energy for ejection of the ink, the heating device heating the ink in a vicinity of recording devices, and the detection device detecting a temperature in the vicinity of the recording devices, the recording apparatus comprising:

an acquisition unit configured to acquire information relating to the temperature detected by the detection device;

a determination unit configured to determine whether the temperature or a first temperature threshold is higher;

a decision unit configured to decide an upper limit of driving power of the heating device, based on a determination result of the determination unit;

a recording control unit configured to drive the recording devices to control a recording operation; and a heat control unit configured to drive the heating device to control a heating operation during the recording operation, based on the temperature detected by the detection device and a second temperature threshold that is higher than the first temperature threshold, wherein the heat control unit drives the heating device to cause the driving power to be lower than the decided upper limit indicated by the representative temperature related information, and wherein the decision unit decides the upper limit (i) so as to increase the upper limit in a case where the determination unit determines one time that the temperature is lower than the first temperature threshold, and (ii) so as to decrease the upper limit in a case where the determination unit consecutively determines N(N≥2) times that the temperature is higher than the first temperature threshold.

15. A recording apparatus including a recording head, the recording head including a plurality of recording devices containing ink, first and second heating devices, and first and second detection devices, the recording devices each generating energy for ejection of the ink, the first and second heating devices respectively heating the ink in a vicinity of recording devices located at first and second positions of the recording devices, and the first and second detection devices respectively detecting temperatures in the vicinity of the recording devices located at the first and second positions, the recording apparatus comprising:

an acquisition unit configured to acquire information relating to a representative temperature of the temperatures detected by the first and second detection devices;

a determination unit configured to determine whether the representative temperature or a first temperature threshold is higher;

a decision unit configured to decide an upper limit of driving power of each of the first and second heating devices, based on a determination result of the determination unit;

a recording control unit configured to drive the recording devices to control a recording operation; and a heat control unit configured to drive each of the first and second heating devices to control a heating operation during the recording operation, based on the temperatures detected by the first and second detection devices and a second temperature threshold that is higher than the first temperature threshold, wherein the heat control unit drives the first and second heating devices to cause the driving power to be lower than the decided upper limit indicated by the representative temperature related information, and wherein the decision unit decides the upper limit (i) so as to increase the upper limit in a case where the determination unit consecutively determines N(M≥2) times that the representative temperature is lower than the first temperature threshold, and (ii) so as to decrease the upper limit in a case where the determination unit consecutively determines N(N>N) times that the representative temperature is higher than the first temperature threshold.

16. A recording method for recording with use of a recording head including a plurality of recording devices, first and second heating devices containing ink, and first and second detection devices, the recording devices each generating energy for ejection of the ink, the first and second heating devices respectively heating the ink in a vicinity of recording devices located at first and second positions of the recording devices, and the first and second detection devices respectively detecting temperatures in the vicinity of the recording devices located at the first and second positions, the recording method comprising:

acquiring information relating to a representative temperature of the temperatures detected by the first and second detection devices;

determining whether the representative temperature or a first temperature threshold is higher;

deciding an upper limit of driving power of each of the first and second heating devices, based on a determination result in the determination;

driving the recording devices to control a recording operation; and driving each of the first and second heating devices to control a heating operation during the recording operation, based on the temperatures respectively detected by the first and second detection devices and a second temperature threshold that is higher than the first temperature threshold, wherein the first and second heating devices are driven to cause the driving power to be lower than the decided upper limit indicated by the representative temperature related information in the heat control, and wherein, in the decision, the upper limit is decided (i) so as to increase the upper limit in a case where it is determined one time in the determination that the representative temperature is lower than the first temperature threshold, and (ii) so as to decrease the upper limit in a case where it is consecutively determined N(N≥2) times in the determination that the representative temperature is higher than the first temperature threshold.

* * * * *